US007060141B2

(12) United States Patent
Mathew

(10) Patent No.: US 7,060,141 B2
(45) Date of Patent: Jun. 13, 2006

(54) BRUSH-TYPE MAT AND METHOD OF MAKING SAME

(75) Inventor: Joseph Mathew, Kerala (IN)

(73) Assignee: Travancore Mats & Matting Co., Cherthala (IN)

( * ) Notice: Subject to any disclaimer, the term of this patent is extended or adjusted under 35 U.S.C. 154(b) by 421 days.

(21) Appl. No.: 10/253,775

(22) Filed: Sep. 25, 2002

(65) Prior Publication Data

US 2004/0055101 A1 Mar. 25, 2004

(51) Int. Cl.

| | |
|---|---|
| ***A46D 3/00*** | (2006.01) |
| ***B32B 25/00*** | (2006.01) |
| ***B32B 31/12*** | (2006.01) |
| ***B32B 31/26*** | (2006.01) |

(52) U.S. Cl. ..... 156/72; 428/95

(58) Field of Classification Search ..... None
See application file for complete search history.

(56) References Cited

U.S. PATENT DOCUMENTS

2002/0119716 A1* 8/2002 Santhosh ..... 442/1

* cited by examiner

*Primary Examiner*—Sam Chuan Yao
(74) *Attorney, Agent, or Firm*—Epstein Drangel Bazerman & James, LLP.

(57) ABSTRACT

An improved mat is formed with a biodegradable plastic body constituted by a combination of a particular natural rubber latex formation and a particular synthetic rubber formulation, a combination of the two formations having a short shelf life but its individual components having a satisfactorily long shelf life, the mat thus produced having physical characteristics equal or superior to known mats with non-biodegradable plastic bodies.

11 Claims, 1 Drawing Sheet

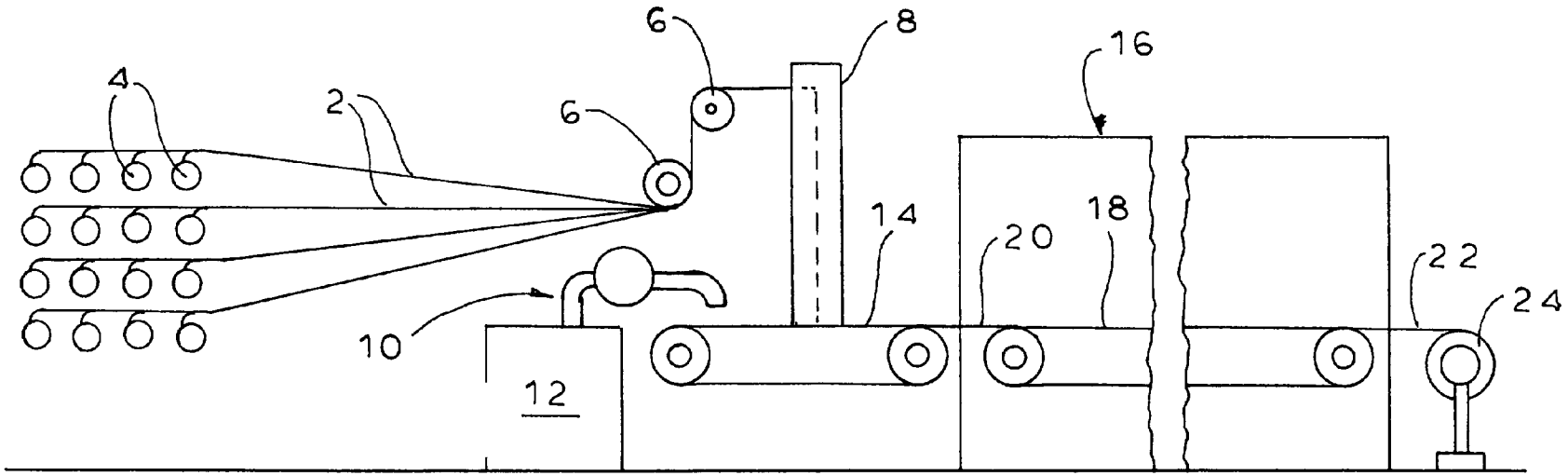
24
22
16
18
20
8
14
6
6
12
10
2
4

BRUSH-TYPE MAT AND METHOD OF MAKING SAME

This invention relates to a brush-type mat with lengths of fibrous materials embedded in and extending up from a base layer of plastic, in which that base layer is essentially formed of a particular combination of biodegradable plastics, the mat having superior physical and chemical characteristics, and to a particularly advantageous method of forming the base layer.

BACKGROUND OF THE INVENTION

Brush-type mats are well known, and are often used as doormats. They consist of a base layer of plastic into which are embedded the ends of tufts of fibrous material, portions of these tufts extending up from the base layer. Since such mats are generally used in applications where they are subjected to extremely rigorous conditions, and therefore must be capable of withstanding these conditions. Accordingly, in the past, the base layer has usually been constituted of a cured plastic having appropriate physical and chemical characteristics, usually polyvinyl chloride or comparable material, into which the lengths of the fabric material forming the tufted portion of the mat are embedded. Those plastic materials, while generally satisfactory in terms of use, have a significant drawback which has recently become relatively critical, to wit, they are not biodegradable. Since mats of the type under discussion have only a finite life and will be discarded at some time, the non-biodegradability of the plastics used in them has become a serious drawback, particularly in view of the increased consciousness on the part of the public of the need for biodegradability. Non-biodegradable curable plastics are, of course, known, but their use in mats of the type under discussion has been contra-indicated because they have not in the past produced mats of adequate physical characteristics, in particular being deficient in the strength with which the tufted lengths of fibrous materials are reliably retained within the plastic layer and the resistance of the mats to tearing or the like.

SUMMARY OF THE INVENTION

In accordance with the present invention, the layer which forms the base of the mat is constituted by a layer of biodegradable plastic material made up largely of rubber, the rubber being provided in a compounded form which in the end product produces physical characteristics, particularly including strength, equal or superior to the strength of the polyvinyl chloride which has previously largely been used for mats. In addition, the essentially rubber compositions used to constitute the layer of the present invention are significantly superior to other latex formulations in terms of shelf life, a very important manufacturing consideration.

These results are accomplished by first forming two different latex mixtures which have comparatively long shelf lives and then combining them to produce a relatively short shelf life combination which can readily be formed into a layer into which the coir or other fibrous materials may be inserted to produce the desired mat when the layer with the fibrous materials embedded and projecting therefrom is cured. One mixture comprises natural rubber latex and an accelerator and the other mixture comprises synthetic rubber latex, a filler and an accelerator.

BRIEF DESCRIPTION OF THE DRAWINGS

The drawing is a schematic representation of the equipment used to form the mats of the present invention.

DESCRIPTION OF THE PREFERRED EMBODIMENT

The drawing discloses a preferred embodiment of the apparatus to produce the mat of the present invention. The fibrous materials generally designated 2 which will form the tufts of the mat are preferably constituted by coir yarn, the fibers being extracted from the husks of coconuts, cleaned and then spun by hand or machine to form yarn. The yarn is provided in a plurality of rolls 4. Many lengths of yarn 2 are unwound from the equally numerous rolls 4 and fed over rollers 6 to an assembly station 8 of known construction and operation, the continuous yarn lengths 2 at this assembly station 8 being cut into short lengths which eventually become the tufts of the mat.

A part of the assembly station 8 is the latex feeding mechanism, generally designated 10, which pumps latex from a container 12 onto a continuous teflon belt 14 to form a layer of latex thereon. The belt 14, which moves from left to right as viewed in the drawing, carries that layer beneath the assembly station 8. The layer on the belt 14 will have a appreciable thickness such as 4–8 mm depending on the desired pulling strength and pile height of the end product. In the assembly station 8 the fibrous material 2 is fed therethrough and cut into short lengths the size of which is determined by the desired thickness on the mat to be produced. The short lengths of fibrous materials are, at the assembly station 8, oriented vertically and pushed down so that their lower ends become embedded in the plastic layer. In this way, a continuous embryonic mat is produced consisting of a continuous layer of uncured latex and a substantially continuous series of tufts of fibrous materials extending up therefrom. That embryonic mat is then subjected to a treatment such as heating in order to cure the latex and thus produce the finished product. To that end, the latex layer with the tufts of fibrous material extending up therefrom is fed from the belt 14 into a curing enclosure generally designated 16 in which a continuous belt 18 receives the layer and tufts and moves it through the heating enclosure 16, which is elongated so that the layer with the fibrous material extending up therefrom is subjected to heat for a long enough period to cure the layer. The heat enclosure 16 preferably comprises a hot air chamber in which the air in the chamber is maintained at an appropriate curing temperature for an appropriate period of time, such as 90° centigrade for 45 minutes. It is preferred to have heating elements both above and below the layer tuft assembly throughout substantially the entire length of the heating enclosure 16 The finally cured continuous mat 22 is moved out from the heating chamber 16 and wound on a reel 24, ready for cutting and shearing as is conventional.

It is most desirable to form a biodegradable latex layer of appropriate characteristics, particularly one having structural strength and strongly retaining the tufts of fibrous material, while at the same time utilizing materials which have a shelf life of many days, so that they are adaptable to economic industrial use. To that end, and in accordance with the present invention, the material to be stored in the container 12 and pumped onto the belt 14 to produce the latex layer is formed of two initially separate mixtures. Each of those mixtures has an appreciable shelf life. These two mixtures may therefore be produced and stored in the plant for appreciable periods of time without any deterioration However, neither of them are themselves capable of forming a commercially adequate layer for receiving the fibrous tufts When these two mixtures are combined, the resultant combination has a relatively short shelf life, but the two mixtures will be combined only when the layer is to be formed In this way, mats may be formed which are comparable or superior to mats using polyvinyl chloride but which, unlike the polyvinyl chloride mats, are biodegradable. These two original mixtures will, for purposes of description, be designated mixture A and mixture B.

Mixture A comprises natural rubber latex and an accelerator. Mixture B comprises synthetic rubber latex, preferably styrene butadiene rubber latex (SBR), a filler, preferably dolomite powder, and an accelerator. The same accelerator may be used in both mixtures if desired. The accelerator is preferably zinc diethyl dithiocarbamate (ZDC). Zinc oxide and sulphur and other conventional chemicals and coloring agents may also be included. Mixture A, before it is combined with mixture B to be used to form a mat, requires maturation before it is ready for use. That is preferably accomplished by keeping the mixture in a room without sunlight at a temperature of 25–30° C. for a period of 3–5 days. When it is matured it should preferably be used within 20 days, which is a comparatively long shelf life. Mixture B can be used as mixed, without maturation, and has a shelf life well in excess of 20 days. When mixture A and mixture B are combined the resultant combination has a shelf life which is much shorter than that of either of mixtures A or B, but since the combination can be formed only when needed for manufacturing its shelf life is quite adequate The use of ZDC as an accelerator is highly preferred, but up to 50% of that ZDC can be substituted for by the zinc salt of mercaptobenzthiazole (ZMBT). The preferred SBR is that sold by Powerene under the designation PLX-802

Two preferred recipes from mixtures A and B are set forth below, but it will be understood that the relative proportions may be varied depending upon the characteristics and conditions of the lattices involved. In particular, the proportions of the chemicals added to the natural latex in mixture A may vary up to plus or minus 10% depending upon the quality and age of the latex received.

In addition, the relative proportions of mixtures A and B, which in the disclosed recipes extend over a ratio range of from 1:1.5 to 1:1.29, these being parts by weight of mixture B to mixture A, might also be varied by plus or minus 10%.

| | Recipe-1 | Recipe-2 | Recipe-1 | Recipe-2 |
|---|---|---|---|---|
| Mixture A | | | | |
| 60% LATEX | 100.00 KGS | 100.00 KGS | 220.00 LBS | 220.00 LBS |
| 50% ZDC DISPERSION | 1.80 KGS | 1.80 KGS | 4.00 LBS | 4.00 LBS |
| 50% SULPHUR | 1.80 KGS | 1.80 KGS | 4.00 LBS | 4.00 LBS |
| 50% ZINC OXIDE | 0.96 KGS | 0.96 KGS | 2.10 LBS | 2.10 LBS |
| Mixture B | | | | |
| DOLOMITE POWDER | 60.00 KGS | 60.00 KGS | 132.00 LBS | 132.00 LBS |
| SBR LATEX (PLX-802) | 30.00 KGS | 20.00 KGS | 66.00 LBS | 44.00 LBS |

-continued

| | Recipe-1 | Recipe-2 | Recipe-1 | Recipe-2 |
|---|---|---|---|---|
| 50% ZDC DISPERSION | 0.15 KGS | 0.10 KGS | 0.33 LBS | 0.22 LBS |
| 50% SULPHUR | 0.30 KGS | 0.20 KGS | 0.66 LBS | 0.44 LBS |
| 50% ZINC OXIDE | 0.90 KGS | 0.60 KGS | 1.98 LBS | 1.32 LBS |

Through the use of separate mixtures of natural rubber latex and styrene butadiene rubber latex, each of which has a shelf life satisfactory for storage in connection with an industrial process, and combining of those two mixtures at the time of use in order to produce a plastic layer into which tufts of fibrous material may be inserted, the layer-fiber combination thereafter being cured, a tufted mat is produced which can compete in strength with mats made with polyvinyl chloride as the plastic but which, unlike the polyvinyl chloride mats, has the very desirable characteristic of being biodegradable.

While preferred embodiments in the present invention have been here disclosed, it will be apparent that variations may be made therein, all within the scope of the present invention as defined in the following claims:

I claim:

1. The method of making a brush-type mat in which lengths of fibrous materials extend upwardly from a biodegradable base layer of plastic into which said lengths are partially embedded, said method comprising:

(a) separately forming relatively long shelf life mixtures A and B, mixture A comprising natural rubber latex and an accelerator and mixture B comprising synthetic rubber latex, filler, and an accelerator;

(b) combining mixtures A and B to produce a relatively short shelf life combination and forming an elongated layer therefrom;

(c) inserting lengths of fibrous material endwise into said layer so that said lengths extend upwardly from said layer; and (d) subjecting said elongated layer with said lengths of fibrous material extending upwardly therefrom to heat to cure said layer.

2. The method of claim 1, in which said synthetic rubber latex is a styrene-butadiene latex.

3. The method of either claims 1 or 2, in which said accelerator comprises zinc diethyl dithiocarbamate.

4. The method of either of claims 1 or 2, in which said filler comprises dolomite powder.

5. The method of either of claims 1 or 2, in which a given mixture also comprises sulphur and zinc oxide.

6. The method of either of claims 1 or 2, in which said accelerator comprises zinc diethyl dithiocarbamate in which said filler comprises dolomite powder.

7. The method of either of claims 1 or 2, in which said accelerator comprises zinc diethyl dithiocarbamate, in which said filler comprises dolomite powder, and in which a given mixture also comprises sulphur and zinc oxide.

8. The method of either claims 1 or 2, in which, in mixture A, for 10 parts by weight of latex the accelerator is present in amounts of about 1.8 parts by weight.

9. The method of either of claims 1 or 2, in which mixture B comprises synthetic rubber latex filler and accelerator in relative proportions by weight of about 2–3 parts of filler per part of latex, the accelerator being present to 0.005 parts.

10. The method of either of claims 1 or 2, in which the mixtures B and A are combined in proportion by weight about 1:1.15 to 1:1.29.

11. The method of either of claims 1 and 2 in which the mixtures B and A are combined in proportion by weight 1:1.43 to 1:1.42.

* * * * *